US008021181B2

(12) United States Patent
Montena et al.

(10) Patent No.: US 8,021,181 B2
(45) Date of Patent: Sep. 20, 2011

(54) LOCKING PHONO PLUG

(75) Inventors: Noah P. Montena, Syracuse, NY (US); David Jackson, Manlius, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 0 days.

(21) Appl. No.: 11/371,807

(22) Filed: Mar. 9, 2006

(65) Prior Publication Data

US 2007/0212922 A1 Sep. 13, 2007

(51) Int. Cl.
*H01R 13/627* (2006.01)

(52) U.S. Cl. ..... 439/352; 439/578

(58) Field of Classification Search ..... 439/578, 439/352, 350

See application file for complete search history.

(56) References Cited

U.S. PATENT DOCUMENTS

| | | | | |
|---|---|---|---|---|
| 3,885,851 | A * | 5/1975 | Bennett | 439/352 |
| 4,533,194 | A * | 8/1985 | Boichut et al. | 439/352 |
| 4,834,675 | A * | 5/1989 | Samchisen | 439/578 |
| 6,093,043 | A * | 7/2000 | Gray et al. | 439/352 |
| 6,247,956 | B1 * | 6/2001 | Porter, Jr. | 439/352 |
| 6,530,807 | B2 * | 3/2003 | Rodrigues et al. | 439/578 |
| 6,695,636 | B2 * | 2/2004 | Hall et al. | 439/352 |

* cited by examiner

*Primary Examiner* — Felix O Figueroa

(74) *Attorney, Agent, or Firm* — Schmeiser, Olsen & Watts, LLP

(57) ABSTRACT

A locking phono plug connector assembly having fingers that grip an interface port to prevent inadvertent disconnection from gravity or unintended disturbance of the wire is provided. A method of fastening/unfastening a plug is also provided, wherein an external sleeve is operated to fasten/unfasten the locking phono plug connector assembly.

18 Claims, 11 Drawing Sheets

LOCKING PHONO PLUG

FIELD OF THE INVENTION

Phono plugs and other connectors for electronics or electrical connections for carrying signals between components or systems.

BACKGROUND

The field of electronics requires cables or wires that are typically shielded to transfer signals between two or more sources. The shielded wires are terminated in plugs to electrically connect and deliver the signal to/from the desired components. An original common industry standard dimension plug has been the RCA style plug. The standard dimensions allow for mass production of connectors and cross compatibility of many items made by different manufacturers. The standard RCA plug may have a ring that would encompass the jack body with a snug fit, but not too snug to prevent easy attachment and removal.

Conventional RCA plugs were originally designed for use on the phonograph players and their use was expanded to all stereo components such as receivers, cassette decks and in recent years other devices such as speakers. The modernization and introduction of audio visual equipment eventually brought the use of RCA plugs on televisions to receive inputs from items such as VCRs, DVD and video game players. The RCA jack is positioned on equipment in the rear to be mainly out of view of the user on the back panel of the component so that the RCA plug and wire is then positioned in a horizontal plane. The placement of the connector horizontally would allow for a loose fitting RCA plugs to still function satisfactorily.

The advent of miniaturization and the trend of wall mounting electrical equipment such as televisions and stereo equipment caused the back or rear vertical face of the component to be inaccessible for plugs. The sides and the bottom of the electrical equipment would then remain available, but plugging cables into the side of wall mounted components placed them directly into view. The solution to reduce the unsightly wires was to move all connections to the bottom that was the easiest to remove wires from view. However, now the plugs became positioned vertically causing loose RCA plugs to either loose proper connectivity with the electrical device or fall completely out. The solution to just make the RCA plug a snugger fitting connection leads to problems of damaging the RCA jack or the inability for some individuals to make a proper connection. Further, once the connector was on a sufficient depth if the plug were too snug when the connector was removed it could result in the damage to the wires of the plug themselves from being pulled from the connector plug because too much force was required. The instant invention addresses all the abovementioned deficiencies and provide numerous other advantages.

SUMMARY OF THE INVENTION

The first embodiment is a connector comprising: a connector body; a post having an exterior surface engageable with the connector body, wherein the exterior surface includes a protruding surface feature; an external sleeve having an internal surface that is slidably engageable with the post; and, a plurality of engagement fingers mechanically interlocked between the post and the internal surface of the external sleeve.

An additional embodiment is disclosed for a locking plug comprising: a connector body having an interior surface; a fastener member having an exterior surface slidably engageable with the interior surface of the connector body; a post having a receiving surface extending from a first end, wherein the first end includes a radially outwardly extending protrusion; an external sleeve having a guide slidably engageable with the receiving surface of the post and including an internal tapered surface; and, a plurality of engagement fingers mechanically interlocked between the radially outwardly extending protrusion of the post and the internal tapered surface of the external sleeve; and, a central terminal axially-positioned within the external sleeve.

Another embodiment is a method of fastening/unfastening a locking plug comprising: providing a connector body; providing a post having an exterior surface engageable with the connector body, wherein the exterior surface includes a protruding surface feature; providing an external sleeve having an internal surface that is slidably engageable with the post; providing a plurality of engagement fingers; mechanically interlocking the plurality of engagement fingers between the post and the internal surface of the external sleeve; retracting the external sleeve toward the connector body to place into an unlocked position; and pushing the external sleeve away from the connector body to place in the locked position.

DETAILED DESCRIPTION OF THE INVENTION

The deficiencies described above such as the connector being either too tight or too loose are solved through the use of a connector assembly 100 comprising a connector body 20 and an external sleeve 12 in combination with a plurality of fingers 10. The connector assembly 100 has a feature of locking and unlocking the connector from the RCA jack to prevent the problems of falling off from excessive looseness or being too tight to easily attach and remove from the RCA jack. The connector assembly 100 may be connected to either end of a wire or cable that may be shielded. The connector assembly 100 as displayed may be substantially round and designed to accept an RCA jack, but the body could be modified by one skilled in the art to be of any configuration and with any number of electrodes or pins. Therefore the external sleeve 12 in conjunction with the plurality of fingers 10 could be adapted to lock or tighten onto any dimension jack to secure the connector assembly 100 onto a jack without requiring either tools or threading screws to prevent unintended release.

Figure 1:
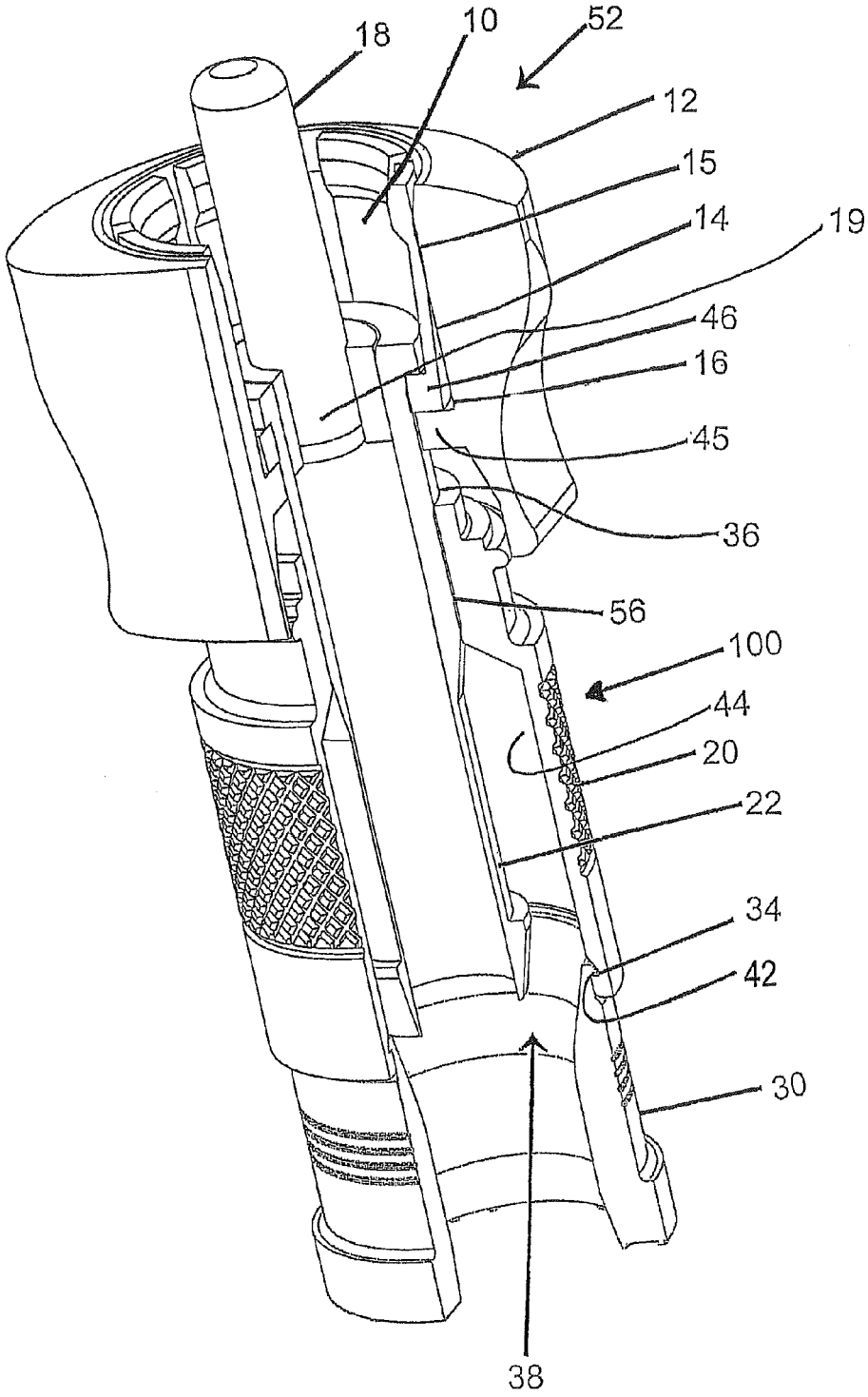
FIG. 1 shows a partial cross sectional view of one embodiment of the invention.
Figure 2:
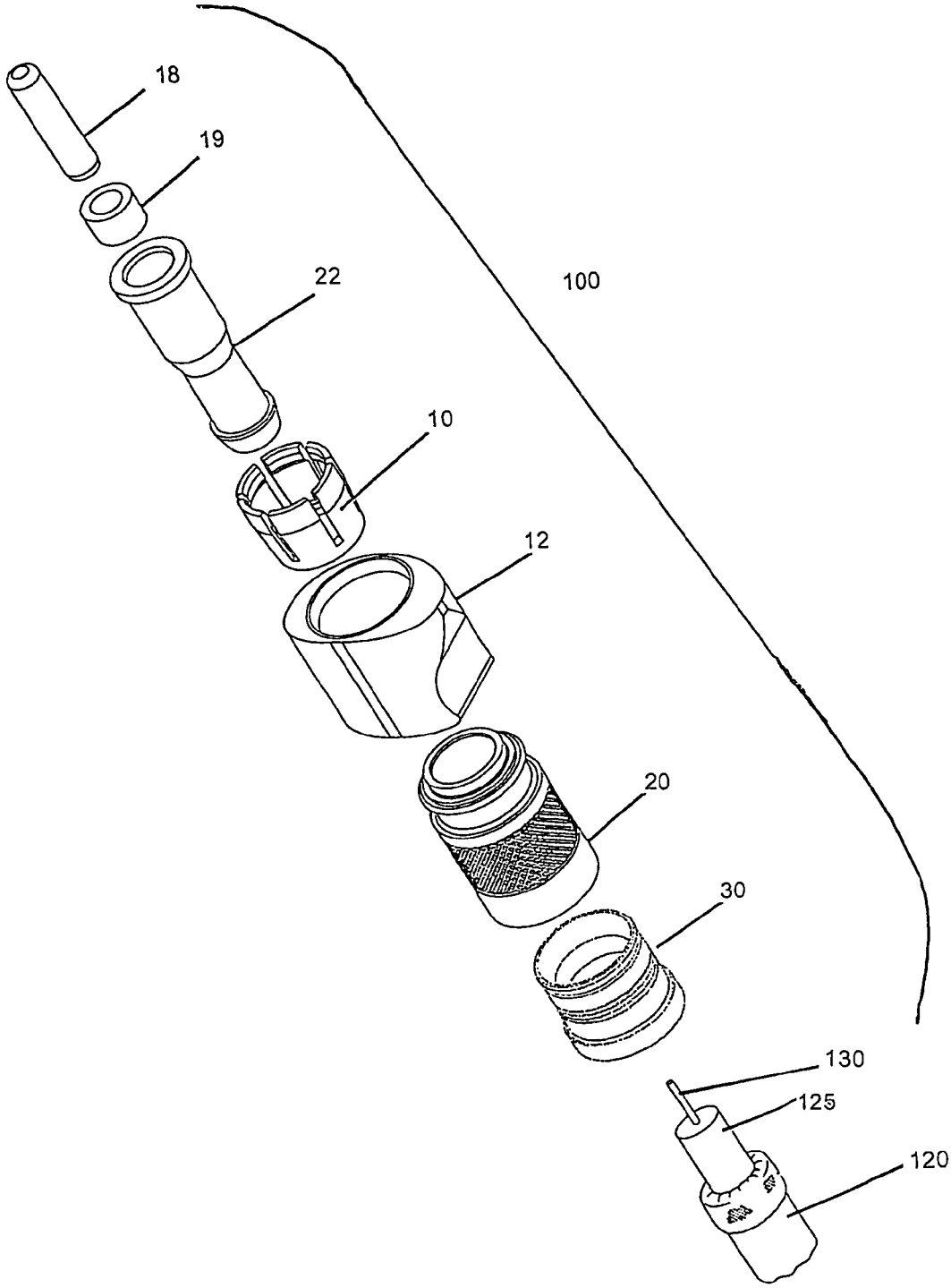
FIG. 2 shows an exploded view of the components of one embodiment.
Figure 3:
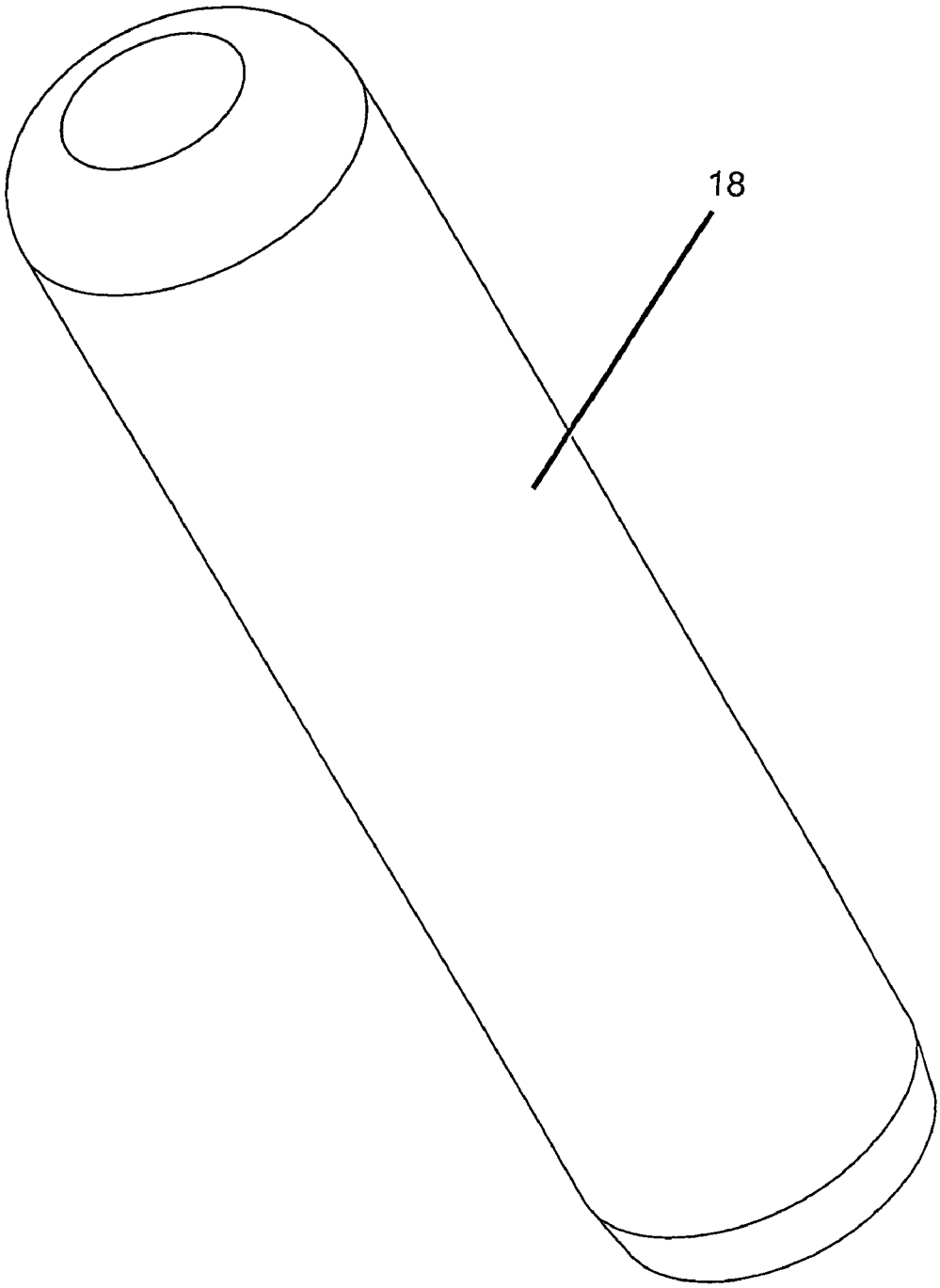
FIG. 3 shows an optional central terminal of one embodiment.
Figure 4:
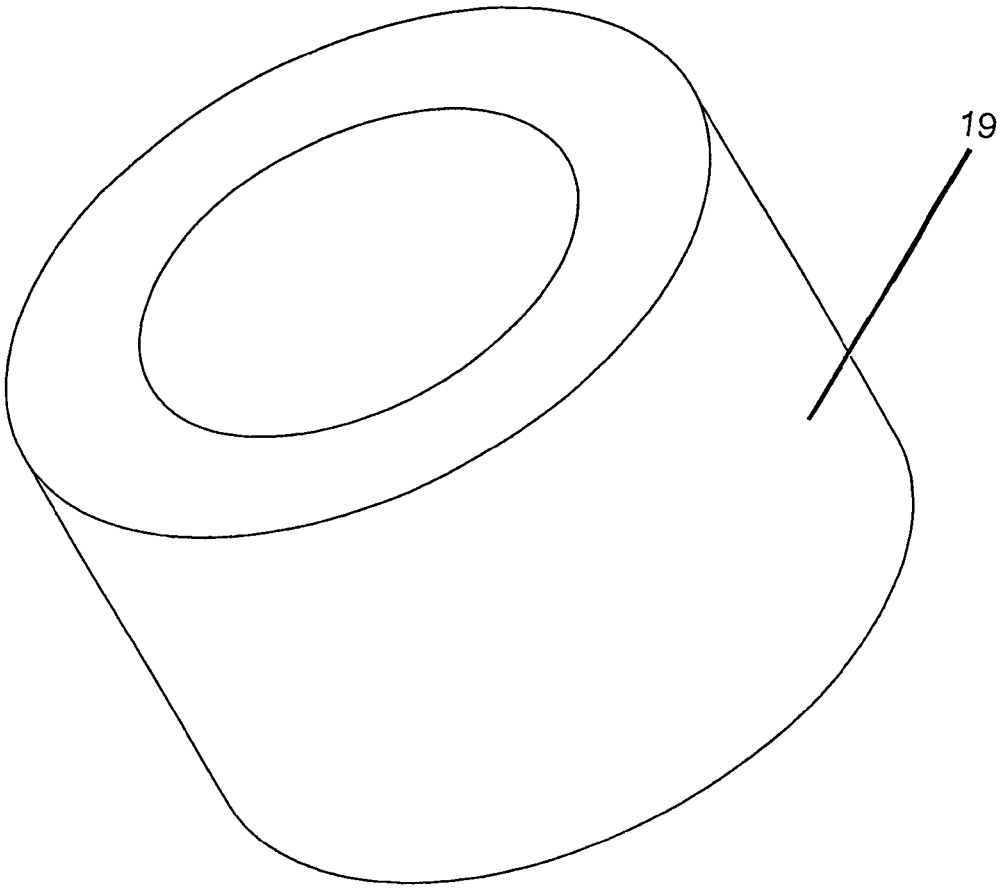
FIG. 4 shows an optional insulator of one embodiment.

In one embodiment of the connector assembly 100, as shown in FIG. 1, the connector body 20 is first attached to an end of a wire or cable (not shown), to which a post 22 having an exterior surface 26 engageable with the connector body 20 is inserted into the cable end (not shown) to secure the connector body 20 onto the cable that may then be compressed on by hand or with the assistance of a compression tool.

Figure 5:
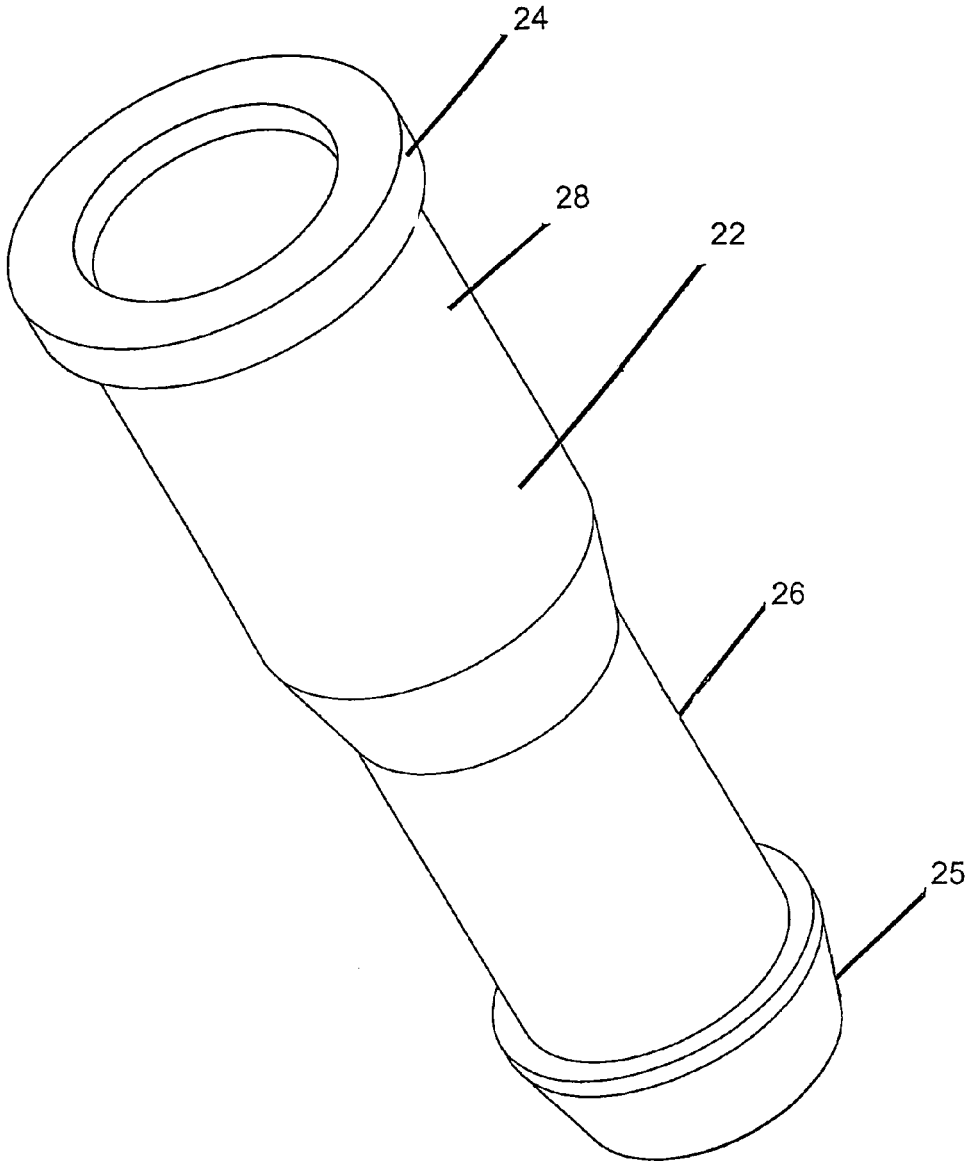
FIG. 5 shows post of one embodiment.
Figure 6:
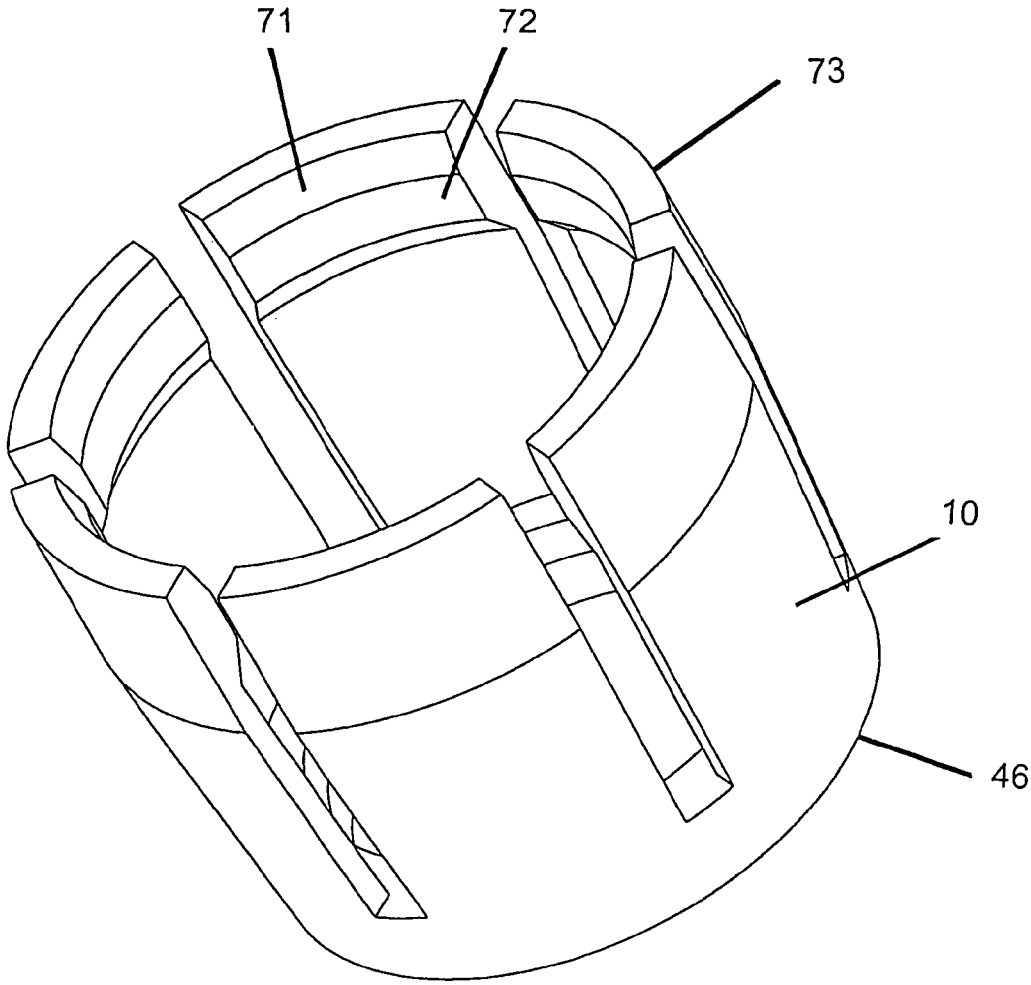
FIG. 6 shows one possible embodiment of fingers.
Figure 7:
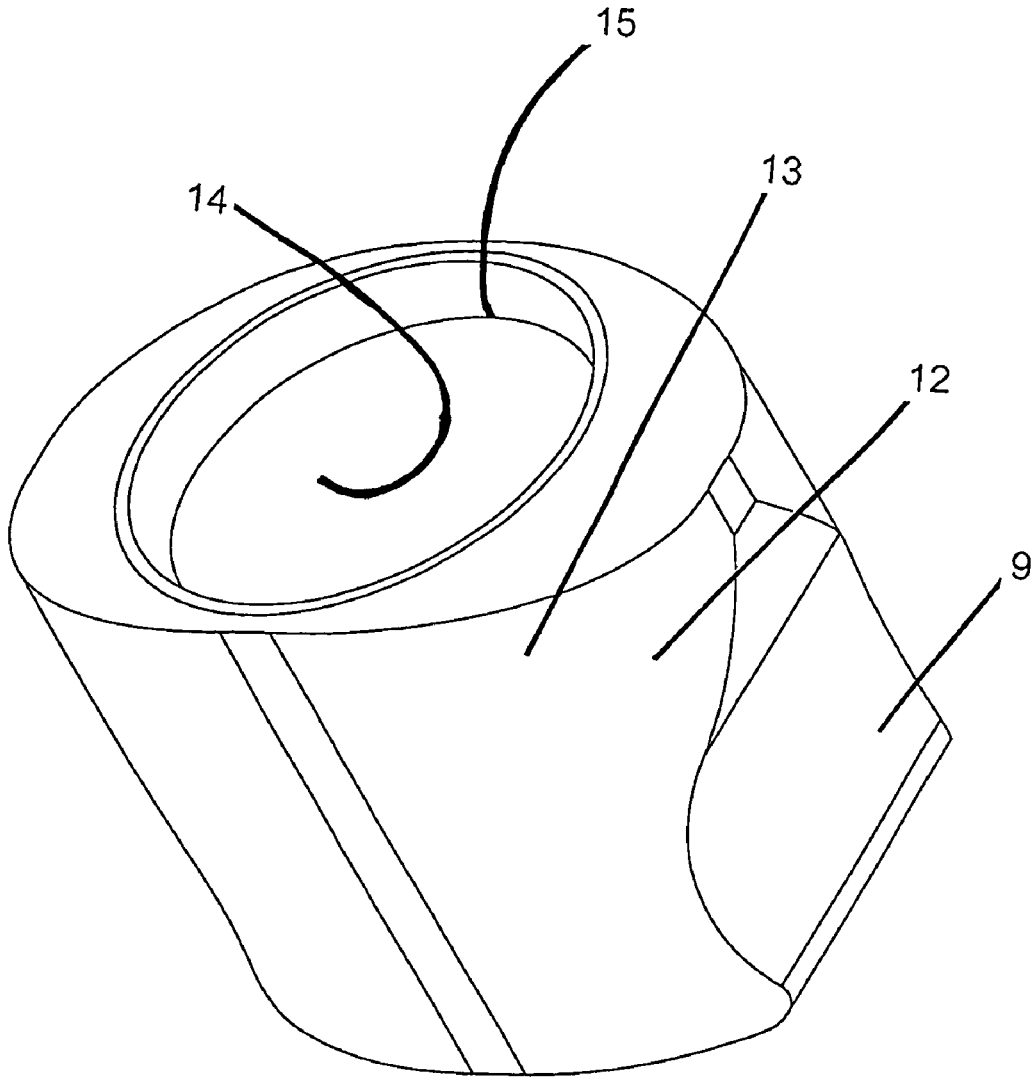
FIG. 7 shows an external sleeve.
Figure 8:
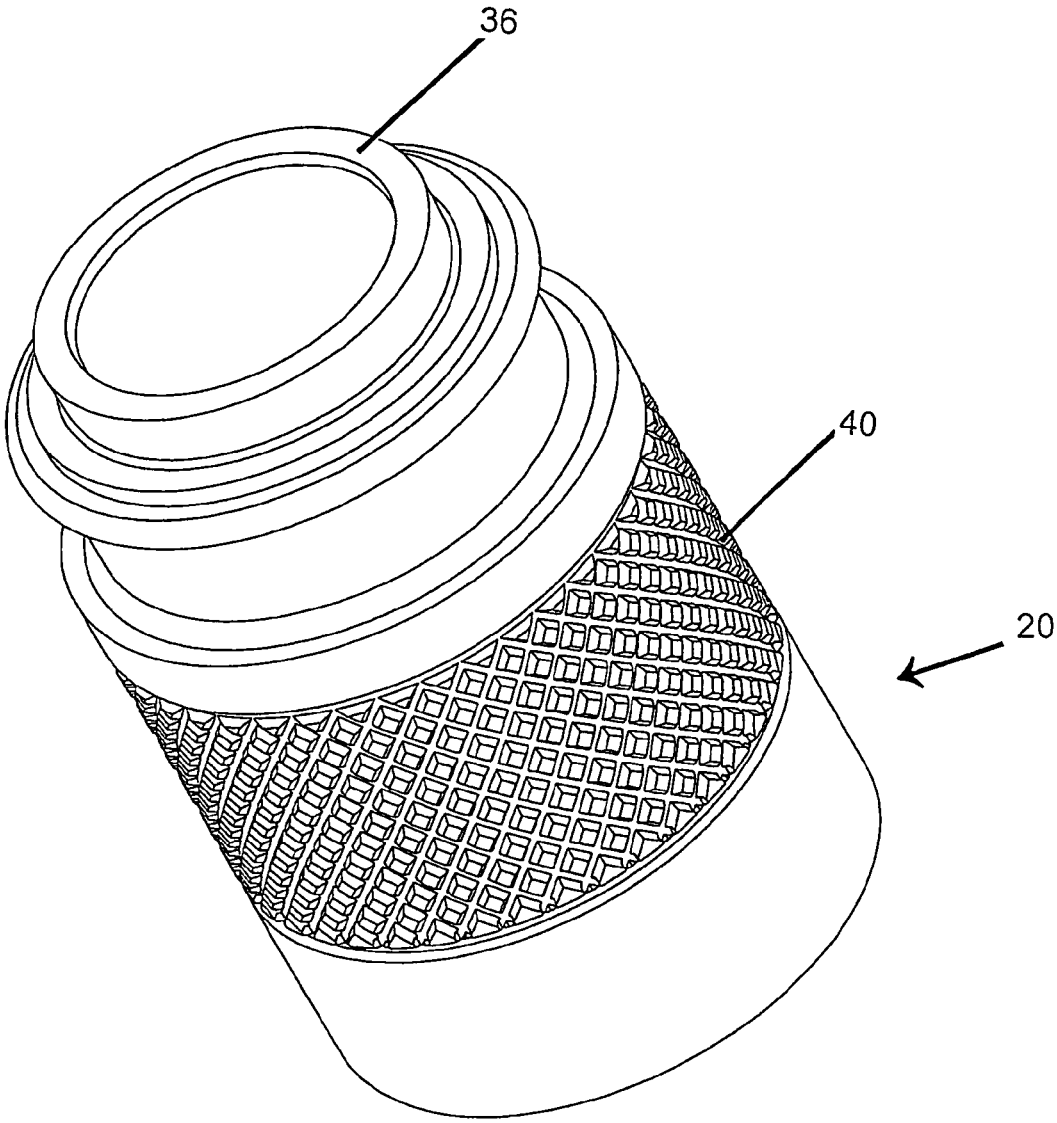
FIG. 8 shows a connector body.
Figure 9:
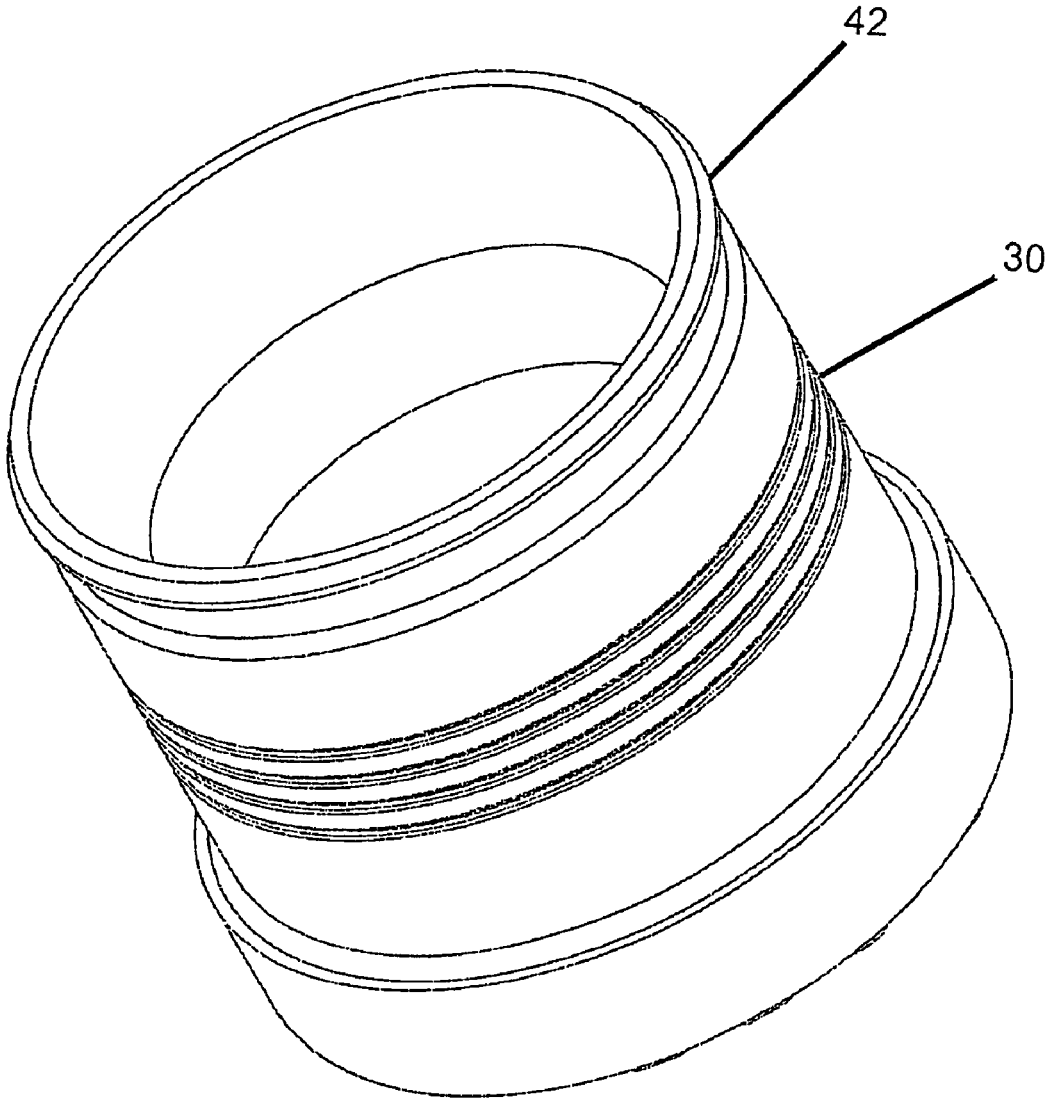
FIG. 9 shows a fastener member.

As shown in FIG. 5, the post 22 has an exterior surface 26 that may include a protruding surface feature 24, which turn may be encompassed by an external sleeve 12 having an internal surface 14 that may be slidably engageable with the post 22. The post 22 can be of any rigid material such as plastic, steel, aluminum or any other suitable alloy. The post 22 may also be made of a polymer that is conductive or coated with a conductive coating on the interior or the exterior surface 26 if required to electrically transmit signals or current. The post may have a retaining member 25 that may comprise an angled entrance ramp with a lip to retain the post within the body of a jacketed wire or cable (not shown). The post retaining member 25 can be any type of protrusion or other surface feature at or near the end of post 22 of sufficient dimension to create sufficient stress in the cable jacketing between the post 22 and connector body 20 to retain the post 22 without loosening or movement after initial assembly.

The post 22 has an exterior surface 26 that may interact with an external sleeve 12. The body of external sleeve 12 may encompass a plurality of engagement fingers 10 that may be mechanically interlocked between the post 22 and the internal surface 14 of the external sleeve 12 (as shown in FIG. 1) when the post 22 is inserted into the cable end (not shown). Moreover, the plurality of engagement fingers 10 may be aligned axially with respect to the connector body 20.

Figure 10:
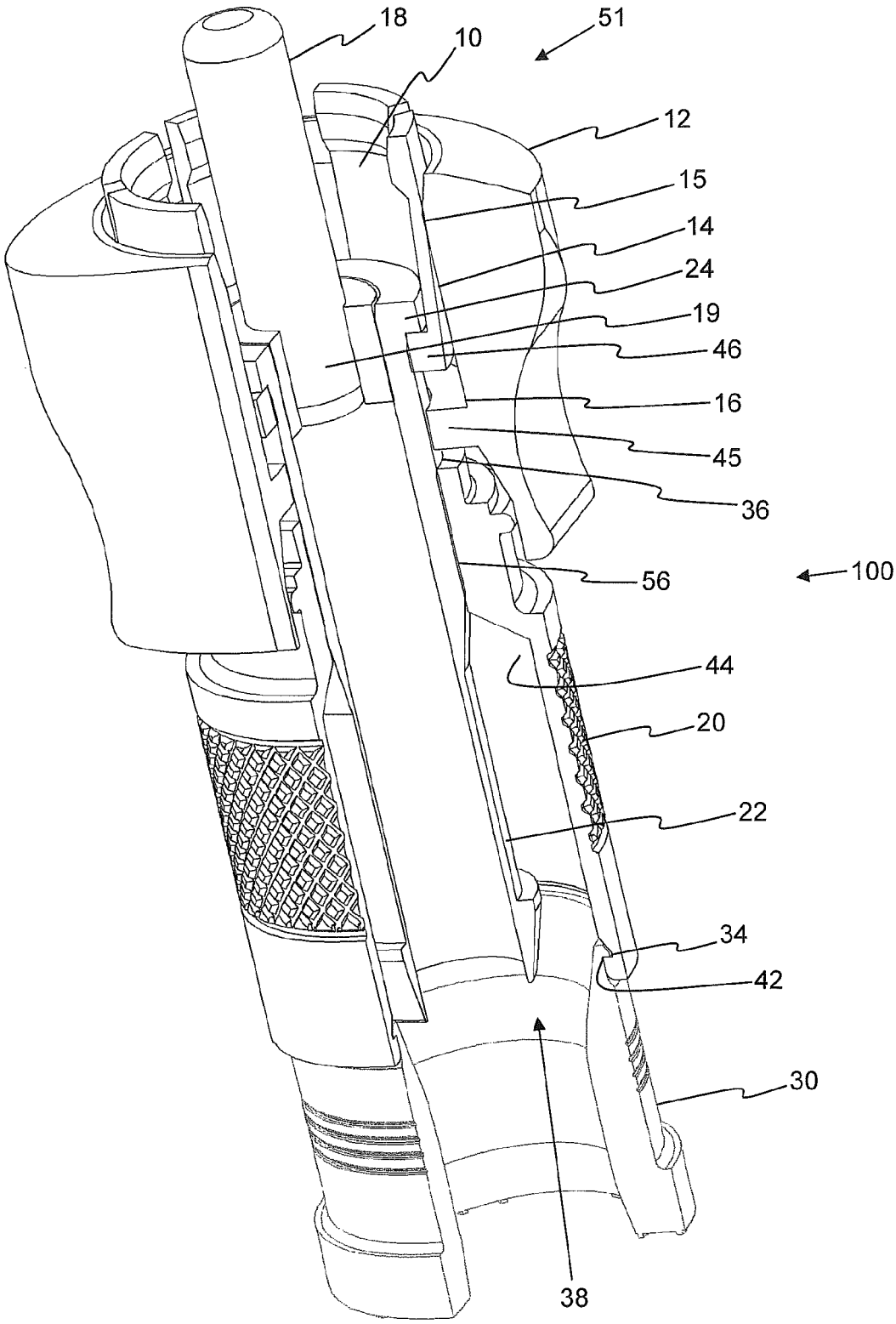
FIG. 10 shows a partial cross sectional view of an embodiment of the invention.
Figure 11:
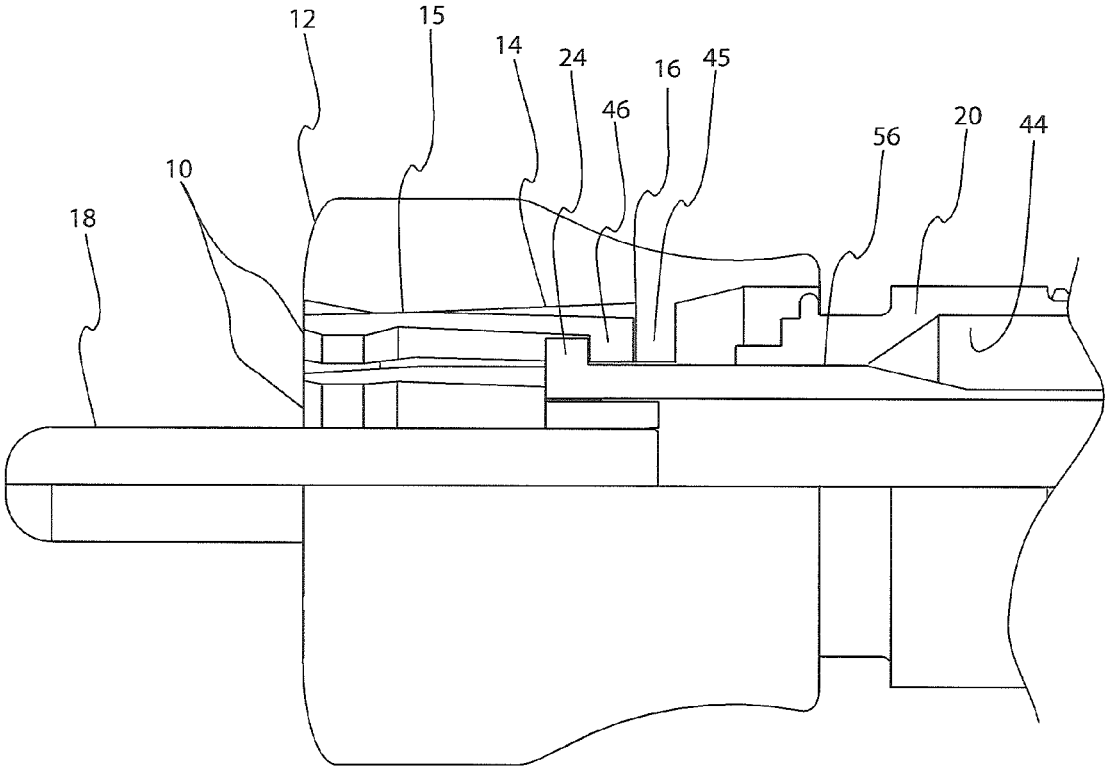
FIG. 11 shows a partial, side, cut-away cross section view of an embodiment of the invention.

The connector assembly 100 may also comprise an internal guide surface portion 28 positioned within the internal surface 14 of the sleeve 12. This internal guide surface portion 28 allows the movement of an internal guide portion 45 of sleeve 12 relative to the fixed connector body 20, which allows the connector assembly 100 to be maneuvered into a tightened or loosened position. The connector assembly 100 is in a first unlocked or loosened position 51, as shown in FIG. 10, wherein the fingers 10 are spread open somewhat like opened flower petals, or other words radially expanded when internal guide portion 45 of the external sleeve 12 resides proximate the connector body edge 36. The connector assembly 100 is in a second locked or tightened position 52, as shown in FIG. 1, when the internal guide portion 45 of the external sleeve 12 resides proximate the plurality of engagement fingers 10.

The plurality of engagement fingers 10 are actuated about the protruding surface feature 24 causing them to pivot and form a greater entrance diameter then when in the unlocked or loosened position. The engagement fingers 10 optionally also includes at the pad tip 72 or pad edge 71 on the plurality of engagement fingers 10 for gripping a jack with even more tension caused by the flexing of the shaft of the fingers 10 keeping the jack in constant spring tension. The fingers 10 are held in tension against the jack by the internal surface 14 of the external sleeve 12. Moreover, means for securing the plurality of engagement fingers 10 into a fixed position as engaged with an interface port may include maneuvering an external sleeve 12 having an internal surface 14 that operates to tighten the fingers 10 onto the interface port. Those in the art should recognize that the interface port may be a common port facilitating connection of RCA jacks, connectors plugs, etc.

The connector body 20 could be formed of a rigid injection molded plastic or it could be made stamped from a metal blank or machined on a lathe or a CNC machine to the desired tolerances from a solid piece. The connector body 20 can either be an insulator or a conductor. The fingers 10 may be made of a resilient material and also having conductive properties such as a plastic filled with conductive material or metal. The fingers 10 could be stamped out of metal, machined or injection molded. The external sleeve 12 could be either made of a rigid plastic or a metal body and need not be conductive. The post 22 may be conductive and it could be either injection molded conductive polymers or a metal that is machined or stamped to the required dimensions.

The connector assembly 100 is used to encompass usually a shielded wire or jacketed cable. Cables such as coaxial cable may have a rigid central wire that may be used alone within the connector assembly to make the electrical connection. Optionally the central wire could be inserted into a central terminal 18 positioned within the connector body 20 to possibly facilitate a better electrical connection. When the central terminal 18 is positioned within the body 20 an insulator 19 may be surrounding the central terminal within the post 22. The external dimensions of the central terminal 18 are defined by the size of the RCA jack terminus that must be compatible in order to have a satisfactory connection and the internal dimensions are controlled by the central wire gauge.

The connector assembly 100 is attached and detached to the RCA jack in part by the operation of the external sleeve 12 that has an upper diameter 15 of the internal surface 14 of the external sleeve 12 wherein the upper diameter 15 in an unlocked position expands the plurality of engagement fingers 10 and when in a locked position contracts the plurality of engagement fingers 10. The external sleeve 12 has a lower diameter 16 of the internal surface 14 of the external sleeve 12 that mechanically retains the plurality of engagement fingers 10 in operation with the post when the external sleeve 12 is moved between the locked and the unlocked positions. 10. The connector assembly 100 may have surfaces 9 upon an outer portion 13 of the external sleeve 12 contoured to ergonomically accept a thumb and a finger to assist in locking and unlocking the connector 100. The connector assembly 100 may have a knurled surface 40 on the connector body 20 to assist in removing the connector body 20 from the RCA jack once the external housing 12 is in the unlocked position.

The connector assembly 100 is fastened onto to the proximate and distal ends of a cable or wire that may contain a nonconductive jacket or coating. To attach the connector assembly 100 to one end of the wires, a fastener member 30 located near the distal end of the post 22, may be compressed toward the connector body 20 press fitting the cable into position with the connector assembly 100. This may help to prevent the electrode from pulling out of the center post and shorting out the connector. To attach the wire to the connector assembly 100 the wire end is inserted into an inner axial bore 38 of the connector body 20 for receiving a cable.

The exterior surface of fastener member 30 may have an external surface feature 42 and the connector body 20 may include an inner surface feature 34, wherein the surface feature 42 may interact with the surface feature 34 to retain the fastener member 30 in a pre-cable assemble position.

The connector assembly 100 may be placed on to an end of a cable 120 having an insulator 125 and a conductive core 130. The connector assembly 100 may be affixed to the cable 120 and the conductive core 130 may be in electrical contact with the central terminal 18. The fastener member 30 operates with the connector body 20 and the post 22 to retain the cable 120.

Still further, an embodiment of a locking plug 100 may comprise a connector body 20 having an interior surface 56. The interior surface 56 of the connector body 20 retains post 22 by a friction fit that allows for easy installation with a compression tool. This friction fit allows for fast production of connecters by a compression tool without the need for welding or soldering connections like are required on prior art connectors. This removes time consuming secondary operations and limits sources of failure from poor welds or soldering. A fastener member 30 having an exterior surface 42 slidably engageable with an interior surface 44 of the connector body 20 maintains the cable by acting as a strain release to prevent pullout of the cable from the connector 100.

A compression tool (not shown) may be utilized to join the connector assembly 100 together and securely fasten component elements to prevent unintended disassembly. A central mechanical fastening component may be the post 22 having a receiving surface 26 extending from a first end, wherein the first end includes a radially outwardly extending protrusion 24. The protrusion 24 at one end and a friction fit with interior surface 56 may facilitate the fastening of component elements of the connector assembly 100 and the cable 120.

A locking mechanism for the fingers may be an external sleeve 12 having a guide 45 that is slidably engageable with the receiving surface portion 28 of the post 22. The guide portion 45 of the external sleeve 12 has an internal dimension less than that of either the protruding surface 24 or the end edge 36 of the connector body 20 that acts as an end stop. The external sleeve 12 has a locked position when guide portion 45 is adjacent or touching the base 46 of the plurality of fingers 10. The external sleeve 12 may include an internal tapered surface 14 that when in the locked position reduces the inner diameter of the plurality of fingers 10 when measured at the inner face 72 of the finger pad 71.

The plurality of fingers 10 are mechanically interlocked between the radially outwardly extending protrusion 24 of the post 22 and the internal tapered surface 14 of the external sleeve 12. Thus when the external sleeve is pulled toward the end edge 36 of the connector body 20 then pressure is removed from the inner face 72 of the plurality of fingers 10 when the inner surface 14 no longer contacts the back side portion 73 of the fingers 10. The elastic fingers 10 thus expand and is easily removed from the jack. The external sleeve 12 has an ergonomic portion 9 to allow the user to grip the external sleeve to aid moving from the locked to the unlocked positions. An optional feature is a gripping surface 40 disposed upon the connector body 20 to aid in removal of the connector 100 once placed into the unlocked position. Also optionally available is a central terminal 18 axially-positioned within the external sleeve 12 to aid in the transmission of the signal from the cable 120 to the jack.

An optional feature to further assist in getting a positive lock is to have an upper diameter 15 having a reduced diameter compared to the rest of the internal surface 14 of the external sleeve 12. The upper diameter 15 when the external sleeve 12 is in an unlocked position expands the plurality of engagement fingers 10 and when in a locked position contracts the plurality of engagement fingers 10.

To further aid in the retention of the connector 100 onto the jack is a lower diameter 16 of the internal surface 14 of the external sleeve 12 that mechanically retains the plurality of engagement fingers 10 when in operation with the post 22 when the external sleeve 12 is moved between the locked and the unlocked positions.

Another feature is an outer portion 13 of the external sleeve 12 also provided in conjunction with the contoured portion 9 to ergonomically accept a thumb and a finger to assist in locking and unlocking the connector. The oval shape of the outer portion 13 is useful to allow for the grasping of plugs if the plugs are in close proximity. The current modern media device may have rows of closely placed jacks that make individual removal and replacement very cumbersome if they were round instead of ergonomically shaped.

An embodiment of a method of fastening/unfastening a locking plug may comprise the steps of providing a connector body 20. Then the next step is providing a post 22 having an exterior surface 26 engageable with the connector body 20, wherein the exterior surface 26 includes a protruding surface feature 24. Then a step may be to provide an external sleeve 12 having an internal surface feature 45 that is slidably engageable with the post 22; and, providing a plurality of engagement fingers 10.

With all the features present then assembling them by mechanically interlocking the plurality of engagement fingers 10 between the post 22 and the internal surface feature 45 of the external sleeve 12. Then a step may include inserting the post 22 containing the plurality of engagement fingers 10 interlocked with the internal surface feature 45 of the external sleeve 12 into the connector body 20. An additional step may be to adjust the depth of the post 22 to allow for the retention and pivoting of the plurality of engagement fingers 10 during sliding of the external sleeve 12 from an unlocked position to a locked position.

Further methodology for fastening/unfastening the connector assembly 100 may include retracting the external sleeve 12 back against the connector body 20 to place into the connector assembly 100 unlocked position. Once unlocked, the external sleeve 12 may be pushed away from the connector body 20 to close the fingers 10 and place the counter assembly 100 in the locked position. A step of unlocking may be the reverse of the steps above. Removal of the connector 100 may include unlocking the external sleeve 12 and then grasping the body 20 and pulling to release the connector 100 from the jack.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

We claim:

1. A coaxial cable connector comprising:

an external sleeve having a tapered internal surface, the internal tapered surface being tapered in one direction along the internal surface from an upper diameter to a lower diameter terminating at an internal surface feature of the external sleeve, wherein the internal surface feature of the external sleeve axially slidably directly engages an internal post member, the post member engaging a connector body; and a locking port interface including a plurality of engagement fingers having a flat outer surface portion, the plurality of engagement fingers mechanically positioned directly between a radially outwardly extending protrusion located at an end of the post member and the external sleeve so that the fingers extend out of the sleeve when the sleeve is in a first position and are compressed by the sleeve and reside within the sleeve when the sleeve is in a second position; and wherein the plurality of engagement fingers is flush with an outermost edge of the external sleeve when the sleeve is in the second position.

2. A coaxial cable connector comprising:

a connector body;

a post engaging the connector body; and a locking mechanism, the locking mechanism including:

a plurality of movable fingers having a flat outer surface portion, the plurality of moveable fingers positioned directly between a radially outwardly extending protrusion located at an end of the post and an axially slidable external sleeve to prevent the axial movement of the external sleeve beyond the radially outwardly extending protrusion located at the end of the post, having an internal tapered surface, the internal tapered surface being tapered in one direction along the internal surface from an upper diameter to a lower diameter terminating at an internal surface feature of the external sleeve, the internal surface feature physically axially slidably engaging the post, further wherein the sleeve in contact with a surface of the post and moveable between a first position and a second position, and wherein the fingers are uncompressed and extend out of the sleeve when the sleeve is in the first position and the fingers are compressed by the sleeve and reside within the sleeve when the sleeve is in the second position; and wherein the plurality of moveable fingers is flush with an outermost edge of the external sleeve when the sleeve is in the second position.

3. A locking coaxial cable connector for connecting to an interface port comprising:

a connector body;

a post having an exterior surface directly engaging the connector body;

a plurality of fingers having a flat outer surface portion, the plurality of fingers aligned axially with respect to the connector body and mechanically positioned between a radially outwardly extending protrusion located at an end of the post and an external sleeve with an internal tapered surface to prevent the axial movement of the external sleeve beyond the radially outwardly extending protrusion located at the end of the post, the internal tapered surface being tapered in one direction along the internal surface from an upper diameter to a lower diameter terminating at an internal surface feature of the external sleeve, the internal surface feature physically engaging the post, and the external sleeve axially slidably engaged with the exterior surface of the post, wherein the plurality of fingers move between a spread open finger configuration wherein the fingers extend out of the sleeve and a tightened finger configuration, said plurality of fingers configured to engage the interface port;

wherein the plurality of fingers is flush with an outermost edge of the external sleeve, when the sleeve is in a locked position; and means for contacting and movably contracting and securing the fingers into a fixed tightened position as engaged with the interface port.

4. A locking coaxial cable connector plug comprising:

a connector body having an interior surface;

a post having an external surface extending from a first end, wherein the first end includes a radially outwardly extending protrusion;

an external sleeve having a guide axially slidably engaging the external surface of the post and the external sleeve including an internal tapered surface being tapered in one direction along the internal surface from an upper diameter to a lower diameter terminating at an internal surface feature of the external sleeve, the internal surface feature physically engaging the post, wherein the sleeve is movable between an unlocked position and a locked position; and a plurality of engagement fingers having a flat outer surface portion, the plurality of engagement fingers mechanically located between the radially outwardly extending protrusion of the post and the internal tapered surface of the external sleeve to prevent the axial movement of the external sleeve beyond the radially outwardly extending protrusion when in the locked position, the fingers making contact with the internal tapered surface of the external sleeve, wherein the internal tapered surface of the external sleeve operates to move and contract the fingers between a spread open configuration wherein the fingers extend out of the sleeve when the sleeve is in the unlocked position to a tightened configuration when the external sleeve is in the locked position; and wherein the plurality of engagement fingers is flush with an outermost edge of the external sleeve when the sleeve is in the locked position.

5. The locking plug of claim 4 further comprising:

a gripping surface disposed upon the connector body.

6. The locking plug of claim 4, wherein the upper diameter in the unlocked position allows expansion of the plurality of engagement fingers to the spread open configuration and when in the locked position contracts the plurality of engagement fingers to the tightened configuration; and wherein the lower diameter of the internal surface of the external sleeve that mechanically retains the plurality of engagement fingers in operation with the post when the external sleeve is moved between the locked and the unlocked positions.

7. The locking plug of claim 4 further comprising:

an outer portion of the external sleeve contoured to ergonomically accept a thumb and a finger to assist in locking and unlocking the connector.

8. The locking plug of claim 4 further comprising:

a central terminal axially positioned within the external sleeve.

9. A coaxial cable connector comprising:

a connector body;

a post having an exterior surface directly engaging the connector body;

an external sleeve having an internal surface that axially slidably engages the post, wherein the sleeve is movable between an unlocked position and a locked position; and a plurality of engagement fingers having a flat outer surface portion, the plurality of engagement fingers mechanically positioned between a radially outwardly extending protrusion located at an end of the post and the external sleeve to hinder axial movement of the external sleeve beyond the radially outwardly extending protrusion located at the end of the post when in the locked position, the internal surface of the sleeve being tapered in one direction along the internal surface from an upper diameter to a lower diameter terminating at an internal surface feature of the external sleeve, the internal surface feature physically engaging the post, further wherein the external sleeve, makes contact with the fingers in order to move and contract the fingers between a tightened finger configuration, wherein the plurality of engagement fingers is flush with an outermost edge of the external sleeve, when the sleeve is in the locked position, and a spread open configuration wherein the fingers extend out of the sleeve, when the sleeve is in the unlocked position.

10. The connector of claim 9 further comprising:

a central terminal positioned within the body; and, an insulator surrounding the central terminal within the post.

11. The connector of claim 10 further comprising:

a cable having an insulator and a conductive core, wherein the connector body is affixed to the insulator and the conductive core is in electrical contact with the central terminal.

12. The connector of claim 9, wherein the upper diameter in the unlocked position allows expansion of the plurality of engagement fingers to the spread open configuration and when in the locked position contracts the plurality of engagement fingers to the tightened configuration; and wherein the lower diameter of the internal surface of the external sleeve that mechanically retains the plurality of engagement fingers in operation with the post when the external sleeve is moved between the locked and the unlocked positions.

13. The connector of claim 9 further comprising:

an angled cable-retaining collar at the distal end of the post.

14. The connector of claim 9 further comprising:

an inner axial bore of the connector body for receiving a cable.

15. The connector of claim 9 further comprising:

a knurled surface on the connector body.

16. The connector of claim 9, wherein the exterior surface of the post has an external diameter and the connector body includes an inner surface having an internal diameter, further wherein the external diameter of the post facilitates a friction fit with the internal diameter of the connector body.

17. The connector of claim 9 further comprising:

an outer portion of the external sleeve contoured to ergonomically accept a thumb and a finger to assist in locking and unlocking the connector.

18. The connector of claim 9 further comprising:

a pad on the plurality of engagement fingers for gripping a jack.

* * * * *